US011779821B2

(12) United States Patent
Davis et al.

(10) Patent No.: US 11,779,821 B2
(45) Date of Patent: Oct. 10, 2023

(54) SPORTING GOODS INCLUDING MICROLATTICE STRUCTURES

(71) Applicant: Bauer Hockey, Ltd., Blainville (CA)

(72) Inventors: Stephen J. Davis, Van Nuys, CA (US); Dewey Chauvin, Simi Valley (CA)

(73) Assignee: BAUER HOCKEY LLC, Exeter, NH (US)

( * ) Notice: Subject to any disclaimer, the term of this patent is extended or adjusted under 35 U.S.C. 154(b) by 0 days.

(21) Appl. No.: 16/440,691

(22) Filed: Jun. 13, 2019

(65) Prior Publication Data

US 2019/0290982 A1 Sep. 26, 2019

Related U.S. Application Data

(63) Continuation of application No. 15/922,526, filed on Mar. 15, 2018, which is a continuation of application (Continued)

(51) Int. Cl.
*A63B 59/51* (2015.01)
*A43B 1/00* (2006.01)

(Continued)

(52) U.S. Cl.
CPC ..... *A63B 59/51* (2015.10); *A43B 1/00* (2013.01); *A63B 59/54* (2015.10); *A63B 59/70* (2015.10);

(Continued)

(58) Field of Classification Search
CPC ..... A63B 59/51; A63B 59/54; A63B 59/70; A63B 60/08; A63B 60/54; A63B 71/10;

(Continued)

(56) References Cited

U.S. PATENT DOCUMENTS 3,276,784 A * 10/1966 Anderson, Jr. ..... A63C 5/12 280/610
4,042,238 A * 8/1977 Theriault ..... A63B 49/022 428/116

(Continued)

FOREIGN PATENT DOCUMENTS

CA 2294301 A1 1/2000
CA 2949062 A1 11/2015

(Continued)

OTHER PUBLICATIONS

Jacobsen et al., Interconnected self-propagating photopolymer waveguides: An alternative to stereolitography for rapid formation of lattice-based open-cellelar materials:, Twenty-First AnnualInternational Solid Freeform Fabrication Symposium, Austin, TX Aug. 9, 2010, 846-853.

(Continued)

*Primary Examiner* — Jeffrey S Vanderveen

(57) ABSTRACT

A sporting good implement, such as a hockey stick or ball bat, includes a main body. The main body may be formed from multiple layers of a structural material, such as a fiber-reinforced composite material. One or more microlattice structures may be positioned between layers of the structural material. One or more microlattice structures may additionally or alternatively be used to form the core of a sporting good implement, such as a hockey-stick blade. The microlattice structures improve the performance, strength, or feel of the sporting good implement.

39 Claims, 3 Drawing Sheets

Related U.S. Application Data

No. 14/276,739, filed on May 13, 2014, now Pat. No. 9,925,440.

(51) Int. Cl.

| | |
|---|---|
| ***A63B 71/10*** | (2006.01) |
| ***A63B 59/54*** | (2015.01) |
| ***A63B 59/70*** | (2015.01) |
| ***A63B 60/08*** | (2015.01) |
| ***A63B 60/54*** | (2015.01) |
| ***A43B 5/16*** | (2006.01) |
| ***A42B 3/00*** | (2006.01) |
| ***A63B 102/24*** | (2015.01) |
| ***A63B 102/18*** | (2015.01) |
| ***A63B 102/22*** | (2015.01) |

(52) U.S. Cl.

CPC ..... *A63B 60/08* (2015.10); *A63B 60/54* (2015.10); *A63B 71/10* (2013.01); *A42B 3/00* (2013.01); *A43B 5/16* (2013.01); *A63B 2102/18* (2015.10); *A63B 2102/22* (2015.10); *A63B 2102/24* (2015.10); *A63B 2209/00* (2013.01); *A63B 2209/02* (2013.01)

(58) Field of Classification Search

CPC ..... A63B 2102/22; A63B 2209/00; A63B 2209/02; A63B 2102/24; A63B 2102/18; A43B 1/00; A43B 5/16; A42B 3/00

See application file for complete search history.

(56) References Cited

U.S. PATENT DOCUMENTS 4,124,208 A * 11/1978 Burns ..... A63B 59/70 473/562
4,134,155 A * 1/1979 Robertson ..... A63B 71/10 2/412
5,217,221 A * 6/1993 Baum ..... A63B 60/00 473/561
5,524,641 A * 6/1996 Battaglia ..... A41D 13/0153 2/463
5,544,367 A * 8/1996 March, II ..... A42B 3/324 2/410
5,593,158 A * 1/1997 Filice ..... A63B 60/08 473/566
5,613,916 A * 3/1997 Sommer ..... A63B 60/54 473/332
5,661,854 A * 9/1997 March, II ..... A42B 3/324 2/410
5,865,696 A * 2/1999 Calapp ..... A63B 59/70 473/561
5,946,734 A * 9/1999 Vogan ..... A63B 71/081 2/200.1
6,015,156 A 1/2000 Pratt
6,033,328 A * 3/2000 Bellefleur ..... A63B 60/08 473/561
6,079,056 A * 6/2000 Fogelberg ..... A41D 13/0153 2/92
6,129,962 A * 10/2000 Quigley ..... B29C 48/12 428/36.1
6,247,181 B1 * 6/2001 Hirsch ..... A42B 1/041 2/412
6,763,611 B1 7/2004 Fusco
6,805,642 B2 * 10/2004 Meyer ..... A63B 60/54 473/320
6,918,847 B2 * 7/2005 Gans ..... A63B 59/70 473/563
7,008,338 B2 * 3/2006 Pearson ..... A63B 59/70 473/563
7,097,577 B2 * 8/2006 Goldsmith ..... B29C 70/44 473/563
7,120,941 B2 10/2006 Glaser
7,178,428 B2 * 2/2007 Schroder ..... B25D 1/00 473/549
7,207,907 B2 * 4/2007 Guenther ..... A63B 60/50 473/566
7,244,196 B2 * 7/2007 Kennedy, III ..... A63B 45/00 473/378
7,382,959 B1 * 6/2008 Jacobsen ..... G02B 1/005 430/290
7,387,578 B2 * 6/2008 Palumbo ..... A63B 53/04 473/320
7,424,967 B2 * 9/2008 Ervin ..... B32B 3/12 428/116
7,476,167 B2 * 1/2009 Garcia ..... A63B 59/70 473/563
7,510,206 B2 * 3/2009 Walker ..... A63C 5/025 280/600
7,614,969 B2 * 11/2009 Meyer ..... A63B 60/54 D21/724
7,625,625 B2 * 12/2009 Rios ..... B32B 27/20 156/60
7,627,938 B2 * 12/2009 Kim ..... A61K 9/0021 604/290
7,786,243 B2 * 8/2010 Wu ..... A63B 37/0003 528/68
7,824,591 B2 * 11/2010 Gans ..... B29C 70/86 473/561
7,906,191 B2 * 3/2011 Pratt ..... A63B 60/54 280/610
7,931,549 B2 * 4/2011 Pearson ..... A63B 59/70 473/560
7,941,875 B1 5/2011 Doctor et al.
7,963,868 B2 * 6/2011 McGrath ..... A63B 60/54 473/563
7,994,269 B2 * 8/2011 Ricci ..... C08G 18/73 473/378
8,007,373 B2 8/2011 Soracco
8,052,551 B2 * 11/2011 Blotteaux ..... A63B 60/06 473/563
8,088,461 B2 1/2012 Fujihana et al.
8,287,403 B2 * 10/2012 Chao ..... C22C 38/001 420/34
8,323,130 B1 * 12/2012 LeVault ..... A63B 60/10 473/549
8,449,411 B2 * 5/2013 LeVault ..... A63B 49/08 473/549
8,602,923 B2 * 12/2013 Jeanneau ..... A63B 59/70 473/562
8,608,597 B2 * 12/2013 Avnery ..... A63B 59/70 473/561
8,623,490 B2 1/2014 Lin et al.
8,663,027 B2 3/2014 Morales et al.
8,801,550 B2 * 8/2014 Jeanneau ..... A63B 60/48 473/563
8,921,702 B1 * 12/2014 Carter ..... H05K 1/0272 361/689
8,998,754 B2 * 4/2015 Shocklee ..... A63B 60/42 473/566
9,044,657 B2 * 6/2015 Jeanneau ..... A63B 59/70
9,056,229 B2 6/2015 Hungerbach et al.
9,086,229 B1 * 7/2015 Roper ..... G02B 5/08
9,116,428 B1 * 8/2015 Jacobsen ..... B32B 3/12
9,119,433 B2 * 9/2015 Leon ..... A42B 3/06
9,199,139 B2 12/2015 Kronenberg et al.
9,201,988 B2 12/2015 Stanhope et al.
9,283,895 B2 * 3/2016 Sumi ..... B32B 5/18
9,320,316 B2 4/2016 Guyan et al.
9,320,317 B2 4/2016 Bernhard et al.
9,375,041 B2 6/2016 Plant
9,409,065 B2 8/2016 Morales et al.
9,415,269 B2 8/2016 Tomita et al.
9,452,323 B2 9/2016 Kronenberg et al.
9,468,823 B2 * 10/2016 Mitton ..... A63B 60/22
9,486,679 B2 * 11/2016 Goldstein ..... B33Y 10/00
9,498,014 B2 11/2016 Princip et al.
9,539,487 B2 1/2017 Henry
9,566,758 B2 * 2/2017 Cheung ..... E04C 3/02
9,573,024 B2 2/2017 Bender

(56) References Cited

U.S. PATENT DOCUMENTS 9,586,112 B2 * 3/2017 Sola ..... A63B 60/06
9,594,368 B2 3/2017 Kronenberg et al.
9,668,531 B2 6/2017 Nordstrom et al.
9,694,540 B2 7/2017 Trockel
9,737,747 B1 * 8/2017 Walsh ..... A63B 49/02
9,756,894 B2 9/2017 McDowell et al.
9,756,899 B2 9/2017 Waatti
9,788,594 B2 10/2017 Jarvis
9,788,603 B2 10/2017 Jarvis
9,795,181 B2 10/2017 Jarvis
9,839,251 B2 * 12/2017 Pannikottu ..... A42B 3/121
9,841,075 B2 * 12/2017 Russo ..... A41D 13/0156
9,878,217 B2 1/2018 Morales et al.
9,889,347 B2 2/2018 Morales et al.
9,892,214 B2 * 2/2018 Morrow ..... B29C 64/386
9,925,440 B2 3/2018 Davis et al.
10,010,133 B2 7/2018 Guyan
10,010,134 B2 7/2018 Guyan
10,016,013 B2 7/2018 Kormann et al.
10,034,519 B2 7/2018 Lussier
10,039,343 B2 8/2018 Guyan
10,052,223 B2 8/2018 Turner
10,085,508 B2 * 10/2018 Surabhi ..... A42B 3/065
10,104,934 B2 10/2018 Guyan
10,143,252 B2 12/2018 Nordstrom et al.
10,143,266 B2 12/2018 Spanks
10,155,855 B2 12/2018 Farris et al.
10,212,983 B2 2/2019 Knight
10,226,098 B2 3/2019 Guyan et al.
10,231,510 B2 3/2019 Wawrousek et al.
10,231,511 B2 3/2019 Guyan et al.
10,244,818 B2 4/2019 Desjardins et al.
10,258,093 B2 4/2019 Smart
10,259,041 B2 4/2019 Gessler et al.
10,264,851 B2 4/2019 Waatti
10,279,235 B2 * 5/2019 Jean ..... A63B 71/0045
10,293,565 B1 5/2019 Tran et al.
10,299,722 B1 5/2019 Tran et al.
10,322,320 B2 6/2019 Morales et al.
10,327,700 B2 6/2019 Lee et al.
10,335,646 B2 7/2019 Morales et al.
10,343,031 B1 * 7/2019 Day ..... A63B 53/0433
10,362,829 B2 * 7/2019 Lowe ..... A42B 3/128
10,384,106 B2 * 8/2019 Hunt ..... A63B 60/54
10,390,578 B2 8/2019 Kuo et al.
10,394,050 B2 8/2019 Rasschaert et al.
10,398,948 B2 9/2019 Cardani et al.
10,426,213 B2 * 10/2019 Hyman ..... A42B 3/121
10,455,896 B2 10/2019 Sterman et al.
10,463,525 B2 11/2019 Littlefield et al.
10,470,519 B2 11/2019 Guyan et al.
10,470,520 B2 11/2019 Guyan et al.
10,517,381 B2 12/2019 Frash
10,525,315 B1 * 1/2020 Wells ..... A63B 1/00
10,575,586 B2 3/2020 Guyan et al.
10,575,587 B2 3/2020 Guyan
10,575,588 B2 3/2020 Perrault et al.
10,591,257 B1 3/2020 Barr et al.
10,624,413 B2 4/2020 Kirk et al.
10,631,592 B2 4/2020 Lee-Sang
10,632,010 B2 4/2020 Hart et al.
10,638,805 B2 5/2020 Fella
10,638,810 B1 5/2020 Cheney et al.
10,638,927 B1 5/2020 Beard et al.
10,646,356 B2 5/2020 Deshpande et al.
10,668,334 B2 6/2020 Madson et al.
10,695,642 B1 6/2020 Robinson
10,696,066 B2 6/2020 Miller
10,702,012 B2 7/2020 Guyan
10,702,740 B2 7/2020 Tarkington et al.
10,721,990 B2 7/2020 Campos et al.
10,737,147 B2 8/2020 Morales et al.
10,743,610 B2 8/2020 Guyan et al.
10,750,820 B2 8/2020 Guyan
10,751,590 B1 8/2020 Wells et al.
10,779,614 B2 9/2020 Re et al.
10,791,787 B2 10/2020 Hector et al.
10,792,541 B2 10/2020 Cardani et al.
10,829,640 B2 11/2020 Beyer et al.
10,835,786 B2 11/2020 Morales et al.
10,842,210 B2 11/2020 Nordstrom et al.
10,850,165 B2 12/2020 Nürmberg et al.
10,850,169 B1 12/2020 Day et al.
10,864,105 B2 12/2020 Dillingham
10,864,676 B2 12/2020 Constantinou et al.
10,875,239 B2 * 12/2020 McCluskey ..... B33Y 70/00
10,881,167 B2 1/2021 Jeng et al.
10,888,754 B2 1/2021 Wells et al.
10,890,970 B2 1/2021 Emokpae
10,893,720 B2 1/2021 Atta
10,899,868 B2 1/2021 Rolland et al.
10,932,500 B2 3/2021 Thomas et al.
10,932,515 B2 3/2021 Busbee
10,932,521 B2 3/2021 Perrault et al.
10,933,609 B2 3/2021 Gupta et al.
10,946,583 B2 3/2021 Constantinou et al.
10,948,898 B1 3/2021 Pietrzak et al.
10,974,447 B2 4/2021 Constantinou et al.
11,026,482 B1 6/2021 Unis
11,033,796 B2 6/2021 Bologna et al.
11,052,597 B2 7/2021 MacCurdy et al.
D927,084 S 8/2021 Bologna et al.
11,076,656 B2 8/2021 Kormann et al.
11,090,863 B2 8/2021 Constantinou et al.
11,111,359 B2 9/2021 Kunc et al.
11,155,052 B2 10/2021 Jessiman et al.
11,167,198 B2 11/2021 Bologna et al.
11,167,395 B2 11/2021 Merlo et al.
11,167,475 B2 11/2021 Donovan
11,172,719 B2 11/2021 Briggs
11,178,938 B2 11/2021 Kulenko et al.
11,185,123 B2 11/2021 Waatti et al.
11,185,125 B2 11/2021 Blanche et al.
10,918,157 B2 12/2021 Choukeir
11,191,319 B2 12/2021 Weisskopf et al.
11,206,895 B2 12/2021 Hopkins et al.
11,219,270 B2 1/2022 Oleson et al.
11,224,265 B2 1/2022 Jarvis
11,229,259 B2 1/2022 Farris et al.
2005/0245090 A1 * 11/2005 Mori ..... G02B 5/1809
438/745
2005/0251898 A1 * 11/2005 Domingos ..... A42B 3/00
2/412
2007/0000025 A1 * 1/2007 Picotte ..... A42B 3/121
2/171
2007/0204378 A1 9/2007 Behar
2007/0270253 A1 * 11/2007 Davis ..... A63B 59/70
473/561
2007/0277296 A1 * 12/2007 Bullock ..... A42B 3/062
2/411
2009/0191989 A1 * 7/2009 Lammer ..... A42B 3/063
473/549
2009/0264230 A1 * 10/2009 Thouin ..... A63B 59/50
156/60
2010/0156058 A1 * 6/2010 Koyess ..... A43B 5/16
12/142 P
2010/0160095 A1 * 6/2010 Chauvin ..... A63B 60/08
473/564
2010/0251465 A1 * 10/2010 Milea ..... A63B 71/10
2/452
2011/0111954 A1 * 5/2011 Li ..... C01B 3/0057
502/417
2012/0297526 A1 * 11/2012 Leon ..... A63B 71/10
2/413
2013/0025031 A1 * 1/2013 Laperriere ..... B29C 69/02
2/414
2013/0025032 A1 * 1/2013 Durocher ..... A42B 3/324
2/414
2013/0143060 A1 * 6/2013 Jacobsen ..... B29C 71/02
156/278
2013/0196175 A1 * 8/2013 Levit ..... B32B 37/02
428/688

(56) References Cited

U.S. PATENT DOCUMENTS

2013/0232674 A1* 9/2013 Behrend ..... A41D 13/0002 2/455
2014/0013492 A1* 1/2014 Bottlang ..... A42B 3/065 2/414
2014/0013862 A1 1/2014 Lind
2014/0075652 A1* 3/2014 Hanson ..... A42B 3/003 2/411
2014/0090155 A1* 4/2014 Johnston ..... A42B 3/127 2/414
2014/0109440 A1 4/2014 McDowell et al.
2014/0163445 A1 6/2014 Pallari et al.
2014/0259327 A1 9/2014 Demarest
2014/0272275 A1* 9/2014 Yang ..... B29D 28/00 428/221
2014/0311315 A1* 10/2014 Isaac ..... G10D 3/22 84/452 R
2015/0018136 A1 1/2015 Goldstein et al.
2015/0121609 A1* 5/2015 Cote ..... A63B 71/10 2/425
2015/0272258 A1* 10/2015 Preisler ..... G01L 1/04 2/412
2015/0298443 A1* 10/2015 Hundley ..... B32B 15/04 156/214
2015/0307044 A1* 10/2015 Hundley ..... B29C 39/38 293/120
2015/0313305 A1 11/2015 Daetwyler et al.
2015/0328512 A1* 11/2015 Davis ..... A63B 59/51 2/425
2016/0135537 A1 5/2016 Wawrousek et al.
2016/0192741 A1* 7/2016 Mark ..... B33Y 10/00 36/43
2016/0206048 A1 7/2016 Weidl et al.
2016/0235560 A1 8/2016 Cespedes et al.
2016/0302494 A1 10/2016 Smart
2016/0302496 A1 10/2016 Ferrara
2016/0327113 A1* 11/2016 Shelley ..... B32B 3/30
2016/0332036 A1 11/2016 Molinari et al.
2016/0333152 A1 11/2016 Cook et al.
2016/0349738 A1 12/2016 Sisk
2016/0353825 A1 12/2016 Bottlang et al.
2016/0374428 A1 12/2016 Kormann et al.
2016/0374431 A1 12/2016 Tow
2017/0021246 A1 1/2017 Goldstein et al.
2017/0105475 A1 4/2017 Huang
2017/0106622 A1 4/2017 Bonin
2017/0164899 A1 6/2017 Yang et al.
2017/0185070 A1 6/2017 Kronenberg et al.
2017/0239933 A1 8/2017 Shiettecatte et al.
2017/0350555 A1 8/2017 Jertson et al.
2017/0251747 A1 9/2017 Pippin
2017/0273386 A1* 9/2017 Kuo ..... A42B 3/0466
2017/0282030 A1 10/2017 Foortse
2017/0303622 A1* 10/2017 Stone ..... A42B 3/065
2017/0318900 A1 11/2017 Charlesworth et al.
2017/0332733 A1 11/2017 Cluckers et al.
2017/0360148 A1 12/2017 Hayes et al.
2018/0007996 A1 1/2018 Sedwick et al.
2018/0027914 A1 2/2018 Cook
2018/0027916 A1* 2/2018 Smallwood ..... A42B 3/223
2018/0028336 A1 2/2018 Pallari et al.
2018/0036944 A1 2/2018 Jarvis
2018/0098589 A1 4/2018 Diamond
2018/0098919 A1 4/2018 Pallari et al.
2018/0103704 A1 4/2018 Smart
2018/0132556 A1* 5/2018 Laperriere ..... A42B 3/064
2018/0140898 A1 5/2018 Kasha
2018/0184732 A1 7/2018 Plant
2018/0200591 A1* 7/2018 Davis ..... A63B 59/70
2018/0231347 A1* 8/2018 Tyler ..... G01L 5/0052
2018/0237600 A1 8/2018 Cox et al.
2018/0253774 A1 9/2018 Soracco et al.
2018/0290044 A1 10/2018 Jin et al.
2018/0339445 A1 11/2018 Loveder
2018/0339478 A1 11/2018 Lee
2018/0341286 A1 11/2018 Markovsky et al.
2018/0345575 A1* 12/2018 Constantinou ..... A43B 13/188
2018/0361217 A1 12/2018 Yanoff et al.
2019/0029367 A1 1/2019 Yangas
2019/0029369 A1 1/2019 VanWagen et al.
2019/0037961 A1 2/2019 Busbee et al.
2019/0039311 A1 2/2019 Busbee et al.
2019/0045857 A1 2/2019 Fan et al.
2019/0075876 A1 3/2019 Burek
2019/0082785 A1 3/2019 Sparks
2019/0090576 A1 3/2019 Guinta
2019/0098960 A1 4/2019 Weisskopf et al.
2019/0104792 A1 4/2019 Diamond
2019/0133235 A1 5/2019 Domanskis et al.
2019/0150549 A1 5/2019 Dunten et al.
2019/0167463 A1 6/2019 Littlefield et al.
2019/0184629 A1 6/2019 Kerrigan
2019/0191794 A1 6/2019 Boria
2019/0200703 A1 7/2019 Mark
2019/0223797 A1 7/2019 Tran et al.
2019/0231018 A1 8/2019 Boutin
2019/0232591 A1 8/2019 Sterman et al.
2019/0232592 A1 8/2019 Tran et al.
2019/0240896 A1 8/2019 Achten et al.
2019/0246741 A1 8/2019 Busbee et al.
2019/0248067 A1 8/2019 Achten et al.
2019/0248089 A1 8/2019 Busbee et al.
2019/0269194 A1 9/2019 Pietrzak et al.
2019/0289934 A1 9/2019 Lee
2019/0290981 A1 9/2019 Davis et al.
2019/0290983 A1 9/2019 Davis et al.
2019/0313732 A1 10/2019 Russell et al.
2019/0329491 A1 10/2019 Yu et al.
2019/0335838 A1 11/2019 Hoshizaki
2019/0344150 A1 11/2019 Dreve
2019/0358486 A1 11/2019 Higginbotham
2019/0365045 A1 12/2019 Kiederle et al.
2019/0381389 A1 12/2019 Nysæther
2019/0382089 A1 12/2019 O'brien
2020/0015543 A1 1/2020 Roser
2020/0022444 A1* 1/2020 Stone ..... A42B 3/062
2020/0029654 A1 1/2020 Yangas
2020/0034016 A1 1/2020 Boissonneault et al.
2020/0046062 A1 2/2020 Perillo et al.
2020/0046075 A1 2/2020 Sterman et al.
2020/0060377 A1 2/2020 Dua et al.
2020/0061412 A1 2/2020 Crosswell
2020/0085606 A1 3/2020 Turner
2020/0094473 A1 3/2020 Constantinou et al.
2020/0100554 A1 4/2020 Bologna et al.
2020/0101252 A1 4/2020 Oddo
2020/0113267 A1 4/2020 Light et al.
2020/0114178 A1 4/2020 Waterford et al.
2020/0121991 A1 4/2020 Emadikotak et al.
2020/0128914 A1 4/2020 Bosmans et al.
2020/0154803 A1 5/2020 Goulet et al.
2020/0154818 A1 5/2020 Fu
2020/0154822 A1 5/2020 Kita et al.
2020/0163408 A1 5/2020 Guyan
2020/0164582 A1 5/2020 Siegl et al.
2020/0170341 A1 6/2020 Guyan et al.
2020/0171742 A1 6/2020 Constantinou et al.
2020/0196706 A1 6/2020 Perrault et al.
2020/0206020 A1 7/2020 Hart et al.
2020/0215415 A1 7/2020 Bologna et al.
2020/0215746 A1 7/2020 Miller
2020/0238604 A1 7/2020 Hart et al.
2020/0255618 A1 8/2020 Krick et al.
2020/0255660 A1 8/2020 Durand et al.
2020/0268077 A1 8/2020 Schmidt et al.
2020/0268080 A1 8/2020 Schmidt et al.
2020/0276770 A1 9/2020 Zheng
2020/0281310 A1 9/2020 Guyan
2020/0283683 A1 9/2020 Yakacki
2020/0297051 A1 9/2020 Quadling et al.
2020/0299452 A1 9/2020 Vontorcik et al.
2020/0305534 A1 10/2020 Chilson
2020/0305552 A1 10/2020 Cheney et al.
2020/0324464 A1 10/2020 Reese et al.

(56) References Cited

U.S. PATENT DOCUMENTS

| | | | |
|---|---|---|---|
| 2020/0329811 | A1 | 10/2020 | Davis |
| 2020/0329814 | A1 | 10/2020 | Wang et al. |
| 2020/0329815 | A1 | 10/2020 | Schmid |
| 2020/0359728 | A1 | 11/2020 | Plant |
| 2020/0367607 | A1 | 11/2020 | Cheney et al. |
| 2020/0368588 | A1 | 11/2020 | Morales et al. |
| 2020/0375270 | A1 | 12/2020 | Holschuh et al. |
| 2020/0390169 | A1 | 12/2020 | Waterloo |
| 2020/0391085 | A1 | 12/2020 | Shassian |
| 2020/0406537 | A1 | 12/2020 | Cross et al. |
| 2021/0001157 | A1 | 1/2021 | Rashaud et al. |
| 2021/0001560 | A1 | 1/2021 | Cook et al. |
| 2021/0016139 | A1 | 1/2021 | Cardani et al. |
| 2021/0022429 | A1 | 1/2021 | Ostergard |
| 2021/0024775 | A1 | 1/2021 | Rolland et al. |
| 2021/0030107 | A1 | 2/2021 | Pratt et al. |
| 2021/0030113 | A1 | 2/2021 | Schuster |
| 2021/0037908 | A1 | 2/2021 | Busbee |
| 2021/0038947 | A1 | 2/2021 | Nürnberg et al. |
| 2021/0052955 | A1 | 2/2021 | Demille et al. |
| 2021/0068475 | A1 | 3/2021 | Coccia et al. |
| 2021/0068495 | A1 | 3/2021 | Telatin et al. |
| 2021/0069556 | A1 | 3/2021 | Morales et al. |
| 2021/0076771 | A1 | 3/2021 | Guyan et al. |
| 2021/0077865 | A1 | 3/2021 | Morales et al. |
| 2021/0079970 | A1 | 3/2021 | Betteridge et al. |
| 2021/0085012 | A1 | 3/2021 | Alvaro |
| 2021/0101331 | A1 | 4/2021 | Su |
| 2021/0112906 | A1 | 4/2021 | Bologna et al. |
| 2021/0117589 | A1 | 4/2021 | Banadyha et al. |
| 2021/0145116 | A1 | 5/2021 | Kvamme |
| 2021/0145125 | A1 | 5/2021 | Miller et al. |
| 2021/0146227 | A1 | 5/2021 | Bhagwat |
| 2021/0169179 | A1 | 6/2021 | Louko |
| 2021/0177090 | A1 | 6/2021 | Vandecruys et al. |
| 2021/0177093 | A1 | 6/2021 | Perrault et al. |
| 2021/0186151 | A1 | 6/2021 | Gross |
| 2021/0186152 | A1 | 6/2021 | Kumar et al. |
| 2021/0186154 | A1 | 6/2021 | Yuasa |
| 2021/0187897 | A1 | 6/2021 | Reinhall et al. |
| 2021/0195982 | A1 | 7/2021 | Pietrzak et al. |
| 2021/0195989 | A1 | 7/2021 | Iwasa et al. |
| 2021/0195995 | A1 | 7/2021 | Sakamoto et al. |
| 2021/0206054 | A1 | 7/2021 | Constantinou et al. |
| 2021/0246959 | A1 | 8/2021 | Kabaria et al. |
| 2021/0283855 | A1 | 9/2021 | Bologna et al. |
| 2021/0299543 | A1 | 9/2021 | Bologna et al. |
| 2021/0321713 | A1 | 10/2021 | Busbee |
| 2021/0321716 | A1 | 10/2021 | Kormann et al. |
| 2021/0341031 | A1 | 11/2021 | Kabaria et al. |
| 2021/0347112 | A1 | 11/2021 | Su et al. |
| 2021/0347114 | A1 | 11/2021 | Boettcher et al. |
| 2021/0354413 | A1 | 11/2021 | Jones et al. |
| 2021/0358097 | A1 | 11/2021 | Harig |
| 2021/0368910 | A1 | 12/2021 | Moller et al. |
| 2021/0368912 | A1 | 12/2021 | Russell et al. |
| 2021/0370400 | A1 | 12/2021 | Benichou et al. |
| 2022/0000212 | A1 | 1/2022 | Busbee |
| 2022/0000216 | A1 | 1/2022 | Carlucci et al. |
| 2022/0007785 | A1 | 1/2022 | Mitchell et al. |
| 2022/0016861 | A1 | 1/2022 | Carlucci et al. |
| 2022/0022594 | A1 | 1/2022 | Dippel et al. |
| 2022/0079280 | A1* | 3/2022 | Laperriere ..... A43B 5/0401 |
| 2022/0142284 | A1* | 5/2022 | Laperriere ..... A42C 2/002 |
| 2022/0296975 | A1 | 9/2022 | Krick et al. |

FOREIGN PATENT DOCUMENTS

| | | | |
|---|---|---|---|
| CA | 3054525 | | 11/2015 |
| CA | 2949062 | | 2/2020 |
| CA | 3054525 | | 2/2022 |
| CA | 3054536 | | 3/2022 |
| CA | 3054547 | | 3/2022 |
| CA | 3054530 | | 5/2022 |
| CA | 3140503 | | 6/2022 |
| CN | 105218939 | | 1/2016 |
| EP | 3142753 | | 8/2019 |
| EP | 3253243 | B1 | 4/2020 |
| NO | 2021228162 | | 11/2021 |
| WO | 2013025800 | A2 | 2/2013 |
| WO | 2013151157 | A1 | 10/2013 |
| WO | 2014100462 | | 6/2014 |
| WO | 2015175541 | A1 | 11/2015 |
| WO | 2016209872 | | 12/2016 |
| WO | 2017062945 | | 4/2017 |
| WO | 2017136890 | | 8/2017 |
| WO | 2017136941 | | 8/2017 |
| WO | 2017182930 | A2 | 10/2017 |
| WO | 2017208256 | A1 | 12/2017 |
| WO | 2018072017 | A1 | 4/2018 |
| WO | 2018072034 | A1 | 4/2018 |
| WO | 2018157148 | | 8/2018 |
| WO | 2018157148 | A1 | 8/2018 |
| WO | 2018161112 | A1 | 9/2018 |
| WO | 2018234876 | A1 | 12/2018 |
| WO | 2019073261 | A1 | 4/2019 |
| WO | 2019086546 | A1 | 5/2019 |
| WO | 2019211822 | A1 | 11/2019 |
| WO | 2020028232 | | 2/2020 |
| WO | 2020028232 | A1 | 2/2020 |
| WO | 2020074910 | A1 | 4/2020 |
| WO | 2020104505 | A1 | 5/2020 |
| WO | 2020104506 | A1 | 5/2020 |
| WO | 2020104511 | A1 | 5/2020 |
| WO | 2020115708 | A1 | 6/2020 |
| WO | 2020118260 | A1 | 6/2020 |
| WO | 2020201666 | A1 | 10/2020 |
| WO | 2020232550 | | 11/2020 |
| WO | 2020232550 | A1 | 11/2020 |
| WO | 2020232552 | | 11/2020 |
| WO | 2020232552 | A1 | 11/2020 |
| WO | 2020232555 | | 11/2020 |
| WO | 2020232555 | A1 | 11/2020 |
| WO | 2020236930 | A1 | 11/2020 |
| WO | 2020245609 | A1 | 12/2020 |
| WO | 2021026406 | A1 | 2/2021 |
| WO | 2021046376 | A1 | 3/2021 |
| WO | 2021062079 | A1 | 4/2021 |
| WO | 2021062519 | | 4/2021 |
| WO | 2021080974 | A1 | 4/2021 |
| WO | 2021101967 | A1 | 5/2021 |
| WO | 2021101970 | A1 | 5/2021 |
| WO | 2021114534 | A1 | 6/2021 |
| WO | 2021238856 | | 12/2021 |

OTHER PUBLICATIONS

Jul. 31, 2015—(PCT)—International Search Report and Written Opinion—App PCT/US15/30383.

Jan. 22, 2018—(EP)—European Search Report—App. No. 15793488.6.

Sep. 20, 2017—(CA) Examiner's Report—App. No. 2,949,062—MM.

Advisory Action dated Jun. 14, 2016 in connection with U.S. Appl. No. 14/276,739, 3 pages.

Advisory Action dated Mar. 21, 2017 in connection with U.S. Appl. No. 14/276,739, 3 pages.

Applicant-Initiated Interview Summary dated Aug. 15, 2017 in connection with U.S. Appl. No. 14/276,739, 3 pages.

Applicant-Initiated Interview Summary dated Jun. 13, 2016 in connection with U.S. Appl. No. 14/276,739, 2 pages.

Notice of Allowance dated Feb. 14, 2018 in connection with U.S. Appl. No. 14/276,739, 2 pages.

Notice of Allowance dated Nov. 16, 2017 in connection with U.S. Appl. No. 14/276,739, 3 pages.

Notice of Allowance dated Nov. 9, 2017 in connection with U.S. Appl. No. 14/276,739, 7 pages.

Office Action dated Aug. 24, 2015 in connection with U.S. Appl. No. 14/276,739, 5 pages.

Office Action dated Dec. 9, 2016 in connection with U.S. Appl. No. 14/276,739, 5 pages.

(56) References Cited

OTHER PUBLICATIONS

Office Action dated Jul. 20, 2016 in connection with U.S. Appl. No. 14/276,739, 5 pages.
Office Action dated Mar. 7, 2016 in connection with U.S. Appl. No. 14/276,739, 6 pages.
Office Action dated May 1, 2017 in connection with U.S. Appl. No. 14/276,739, 7 pages.
Restriction Requirement dated Jun. 9, 2015 in connection with U.S. Appl. No. 14/276,739, 5 pages.
Advisory Action dated Mar. 17, 2021 in connection with U.S. Appl. No. 15/922,526, 3 pages.
Examiner Report dated Nov. 25, 2020 in connection with Canadian Patent Application No. 3054547, 5 pages.
Examiner Report dated Nov. 25, 2020 in connection with Canadian Patent Application No. 3054536, 5 pages.
Examiner Report dated Nov. 24, 2020, in connection with Canadian Patent Application No. 3,054,525, 5 pages.
Examiner Report dated Nov. 25, 2020 in connection with Canadian Patent Application No. 3054530, 7 pages.
Examiner's Report dated Jul. 29, 2019 in connection with Canadian Patent Application 2,949,062, 3 pages.
Final Office Action dated Nov. 23, 2020 in connection with U.S. Appl. No. 15/922,526, 17 pages.
Final Office Action dated Feb. 9, 2021 in connection with U.S. Appl. No. 16/440,655, 39 pages.
Restriction Requirement dated Jul. 17, 2020 in connection with U.S. Appl. No. 16/440,655, 9 pages.
Restriction Requirement dated Mar. 5, 2019 in connection with U.S. Appl. No. 15/922,526, 6 pages.
Written Opinion dated Aug. 20, 2020 in connection with International PCT application No. PCT/CA2020/050683, 8 pages.
Written Opinion dated Aug. 21, 2020 in connection with International PCT application No. PCT/CA2020/050686, 5 pages.
Nritten Opinion dated Aug. 25, 2020 in connection with International PCT application No. PCT/CA2020/050684, 7 pages.
Wang, X. et al., 3D printing of polymer matrix composites: A review and prospective, Composites Part B, 2017, vol. 110, pp. 442-458.
Wirth, D. M. et al. Highly expandable foam for litographic 3D printing, ACS Appl. Mater. Interfaces, 2020, 12 pages 19033-19043.
Examiner Report dated Apr. 27, 2021 in connection with Canadian Patent Application No. 3,054,525, 3 pages.
Examiner Report dated Apr. 27, 2021 in connection with Canadian Patent Application No. 3,054,530,4 pages.
Examiner Report dated Apr. 27, 2021 in connection with Canadian Patent Application No. 3,054,536, 5 pages.
Examiner Report dated Apr. 27, 2021 in connection with Canadian Patent Application No. 3,054,547, 5 pages.
Examiner Report dated Aug. 2, 2021 in connection with Canadian Patent Application No. 3,054,530, 3 pages.
Final Office Action dated Feb. 9, 2021 in connection with U.S. Appl. No. 16/440,717, 35 pages.
International Preliminary Report on Patentability dated Oct. 1, 2021 in connection with International Patent Application PCT/CA2020/050689, 31 pages.
International Preliminary Report on Patentability dated Sep. 14, 2021 in connection with International Patent Application PCT/CA2020/050683, 17 pages.
International Preliminary Report on Patentability dated Sep. 3, 2021 in connection with International Patent Application PCT/CA2020/050686, 54 pages.
International Search Report and Written Opinion dated Aug. 19, 2020 in connection with International Patent Application PCT/CA2020/050689, 11 pages.
International Search Report dated Aug. 20, 2020 in connection with International PCT application No. PCT/CA2020/050683, 5 pages.
International Search Report dated Aug. 21, 2020 in connection with International PCT application No. PCT/CA2020/050686, 4 pages.
International Search Report dated Aug. 25, 2020 in connection with International PCT application No. PCT/CA2020/050684, 6 pages.
Non-Final Office Action dated Jun. 19, 2019 in connection with U.S. Appl. No. 15/922,526, 15 pages.
Non-Final Office Action dated Jun. 5, 2020 in connection with U.S. Appl. No. 15/922,526, 16 pages.
Non-Final Office Action dated Oct. 15, 2020 in connection with U.S. Appl. No. 16/440,655, 41 pages.
Non-Final Office Action dated Oct. 15, 2020 in connection with U.S. Appl. No. 16/440,717, 37 pages.
Non-Final Office Action dated Sep. 7, 2021 in connection with U.S. Appl. No. 16/440,655, 35 pages.
Non-Final Office Action dated Sep. 7, 2021 in connection with U.S. Appl. No. 16/440,717, 31 pages.
Non-Final Office Action dated Sep. 7, 2021 in connection with U.S. Appl. No. 15/922,526, 22 pages.
Final Office Action dated Apr. 4, 2022 in connection with U.S. Appl. No. 16/440,691, 31 pages.
Final Office Action dated Apr. 4, 2022 in connection with U.S. Appl. No. 15/922,526, 24 pages.
Final Office Action dated Apr. 4, 2022 in connection with U.S. Appl. No. 16/440,655, 39 pages.
Final Office Action dated Apr. 4, 2022 in connection with U.S. Appl. No. 16/440,717, 20 pages.
International Preliminary Report on Patentability dated Feb. 8, 2022 in connection with International Patent Application PCT/CA2020/050684, 11 pages.
Written Opinion dated Dec. 14, 2021 in connection with International PCT application No. PCT/CA2020/050684, 7 pages.
Non-Final Office Action dated Mar. 14, 2022 in connection with U.S. Appl. No. 17/611,262, 36 pages.
Non-Final Office Action dated Sep. 9, 2022 in connection with U.S. Appl. No. 16/440,655, 39 pages.
Notice of Allowance dated Sep. 9, 2022 in connection with U.S. Appl. No. 16/440,717, 18 pages.
Restriction Requirement dated Jul. 20, 2020 in connection with U.S. Appl. No. 16/440,691, 6 pages.
Non-Final Office Action dated Sep. 7, 2021 in connection with U.S. Appl. No. 16/440,691, 33 pages.
Final Office Action dated Sep. 8, 2022 in connection with U.S. Appl. No. 17/611,262, 17 pages.
Examiner Report dated Mar. 3, 2023 in connection with Canadian Patent Application No. 3,140,505, 3 pages.
Extended European Search Report dated Jan. 5, 2023 in connection with European Patent Application No. 20810281.4, 10 pages.
Non-Final Office Action dated Jan. 10, 2023 in connection with U.S. Appl. No. 15/922,526, 22 pages.
Final Office Action dated Jan. 10, 2023 in connection with U.S. Appl. No. 16/440,655, 38 pages.
Notice of Allowance dated Feb. 16, 2023 in connection with U.S. Appl. No. 17/611,262, 9 pages.

* cited by examiner

SPORTING GOODS INCLUDING MICROLATTICE STRUCTURES

CROSS-REFERENCE TO RELATED APPLICATIONS

This application is a continuation of U.S. patent application Ser. No. 15/922,526, filed Mar. 15, 2018, which is a continuation of U.S. patent application Ser. No. 14/276,739, filed May 13, 2014, now U.S. Pat. No. 9,925,440. The contents of the aforementioned applications are incorporated herein by reference in their entirety.

BACKGROUND

Lightweight foam materials are commonly used in sporting good implements, such as hockey sticks and baseball bats, because their strength-to-weight ratios provide a solid combination of light weight and performance. Lightweight foams are often used, for example, as interior regions of sandwich structures to provide lightweight cores of sporting good implements.

Foamed materials, however, have limitations. For example, foamed materials have homogeneous, isotropic properties, such that they generally have the same characteristics in all directions. Further, not all foamed materials can be precisely controlled, and their properties are stochastic, or random, and not designed in any particular direction. And because of their porosity, foamed materials often compress or lose strength over time.

Some commonly used foams, such as polymer foams, are cellular materials that can be manufactured with a wide range of average-unit-cell sizes and structures. Typical foaming processes, however, result in a stochastic structure that is somewhat limited in mechanical performance and in the ability to handle multifunctional applications.

SUMMARY

A sporting good implement, such as a hockey stick or ball bat, includes a main body. The main body may be formed from multiple layers of a structural material, such as a fiber-reinforced composite material. One or more microlattice structures may be positioned between layers of the structural material. One or more microlattice structures may additionally or alternatively be used to form the core of a sporting good implement, such as a hockey-stick blade. The microlattice structures improve the performance, strength, or feel of the sporting good implement. Other features and advantages will appear hereinafter.

BRIEF DESCRIPTION OF THE DRAWINGS

In the drawings, wherein the same reference number indicates the same element throughout the views.

DETAILED DESCRIPTION OF THE DRAWINGS

Figure 1:
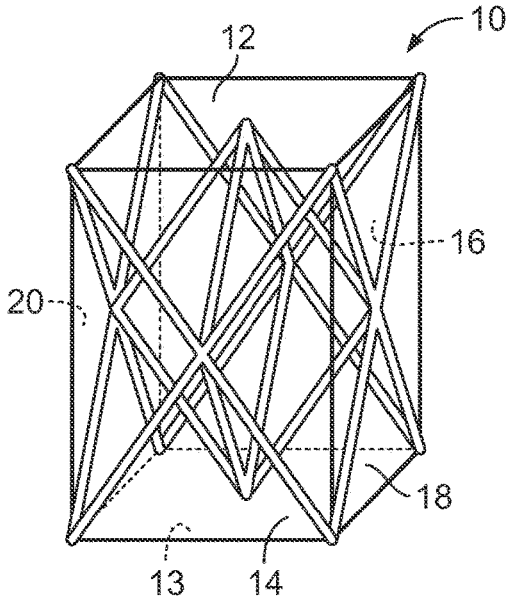
FIG. 1 is a perspective view of a microlattice unit cell, according to one embodiment.

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Micro-scale lattice structures, or "microlattice" structures, include features ranging from tens to hundreds of microns. These structures are typically formed from a three dimensional, interconnected array of self-propagating photopolymer waveguides. A microlattice structure may be formed, for example, by directing collimated ultraviolet light beams through apertures to polymerize a photomonomer material. Intricate three-dimensional lattice structures may be created using this technique.

In one embodiment, microlattice structures may be formed by exposing a two-dimensional mask, which includes a pattern of circular apertures and covers a reservoir containing an appropriate photomonomer, to collimated ultraviolet light. Within the photomonomer, self-propagating photopolymer waveguides originate at each aperture in the direction of the ultraviolet collimated beam and polymerize together at points of intersection. By simultaneously forming an interconnected array of these fibers in three-dimensions and removing the uncured monomer, unique three-dimensional, lattice-based, open-cellular polymer materials can be rapidly fabricated.

The photopolymer waveguide process provides the ability to control the architectural features of the bulk cellular material by controlling the fiber angle, diameter, and three-dimensional spatial location during fabrication. The general unit-cell architecture may be controlled by the pattern of circular apertures on the mask or the orientation and angle of the collimated, incident ultraviolet light beams.

The angle of the lattice members with respect to the exposure-plane angle are controlled by the angle of the incident light beam. Small changes in this angle can have a significant effect on the resultant mechanical properties of the material. For example, the compressive modulus of a microlattice material may be altered greatly with small angular changes within the microlattice structure.

Microlattice structures can provide improved mechanical performance (higher stiffness and strength per unit mass, for example), as well as an accessible open volume for unique multifunctional capabilities. The photopolymer waveguide process may be used to control the architectural features of the bulk cellular material by controlling the fiber angle, diameter, and three-dimensional spatial location during fabrication. Thus, the microlattice structure may be designed to provide strength and stiffness in desired directions to optimize performance with minimal weight.

This manufacturing technique is able to produce three-dimensional, open-cellular polymer materials in seconds. In addition, the process provides control of specific microlattice parameters that ultimately affect the bulk material properties. Unlike stereolithography, which builds up three-dimensional structures layer by layer, this fabrication technique is rapid (minutes to form an entire part) and can use a single two-dimensional exposure surface to form three-dimensional structures (with a thickness greater than 25 mm possible). This combination of speed and planar scalability opens up the possibility for large-scale, mass manufacturing. The utility of these materials range from lightweight energy-absorbing structures, to thermal-management materials, to bio-scaffolds.

A microlattice structure may be constructed by this method using any polymer that can be cured with ultraviolet light. Alternatively, the microlattice structure may be made of a metal material. For example, the microlattice may be dipped in a catalyst solution before being transferred to a nickel-phosphorus solution. The nickel-phosphorus alloy may then be deposited catalytically on the surface of the polymer struts to a thickness of around 100 nm. Once coated, the polymer is etched away with sodium hydroxide, leaving a lattice geometry of hollow nickel-phosphorus tubes.

The resulting microlattice structure may be greater than 99.99 percent air, and around 10 percent less dense than the lightest known aerogels, with a density of approximately 0.9 $mg/cm^3$. Thus, these microlattice structures may have a density less than 1.0 $mg/cm^3$. A typical lightweight foam, such as Airex C71, by comparison, has a density of approximately 60 $mg/cm^3$ and is approximately 66 times heavier.

Further, the microengineered lattice structure has remarkably different properties than a bulk alloy. A bulk alloy, for example, is typically very brittle. When the microlattice structure is compressed, conversely, the hollow tubes do not snap but rather buckle like a drinking straw with a high degree of elasticity. The microlattice can be compressed to half its volume, for example, and still spring back to its original shape. And the open-cell structure of the microlattice allows for fluid flow within the microlattice, such that a foam or elastomeric material, for example, may fill the air space to provide additional vibration damping or strengthening of the microlattice material.

The manufacturing method described above could be modified to optimize the size and density of the microlattice structure locally to add strength or stiffness in desired regions. This can be done by varying:

- the size of the apertures in the mask to locally alter the size of the elements in the lattice;
- the density of the apertures in the mask to locally alter the strength or dynamic response of the system; or
- the angle of the incident collimated light to change the angle of the elements, which affects the strength and stiffness of the material.

The manufacturing method could also be modified to include fiber reinforcement. For example, fibers may be arranged to be co-linear or co-planar with the collimated ultraviolet light beams. The fibers are submersed in the photomonomer resin and wetted out. When the ultraviolet light polymerizes the photomonomer resin, the resin cures and adheres to the fiber. The resulting microlattice structure will be extremely strong, stiff, and light.

FIGS. 1-8 illustrate some examples of microlattice unit cells and microlattice structures. FIG. 1 shows a square unit cell 10 with a top plane 12 and a bottom plane 13 defining the cell shape. This is a single cell that would be adjacent to other similar cells in a microlattice structure. The cell 10 is defined by a front plane 14, an opposing rear plane 16, a right-side plane 18, and a left-side plane 20. It will be used as a reference in the building of a microlattice structure using four collimated beams controlled by a mask with circular apertures to create a lattice structure with struts of circular cross section.

Figure 2:
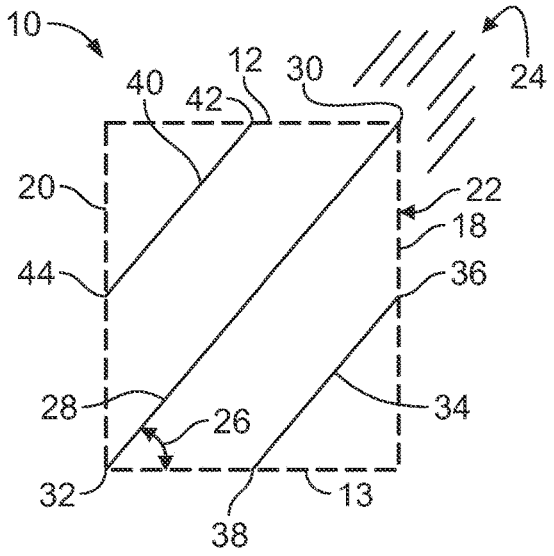
FIG. 2 is a side view of the unit cell of FIG. 1 with a collimated beam of light directed through an upper-right corner of the cell.

FIG. 2 shows a side view of the unit cell 10 with a dashed line 22 indicating the boundary of the cell 10. A collimated beam of light 24 is directed at an angle 26 controlled by a mask with apertures (not shown). A light beam 28 is oriented through an upper-right-corner node 30 and a lower-left-corner node 32. A parallel beam of light 34 is directed through a node 36 positioned on the center of right-side plane 18 and through a node 38 on the center of bottom plane 13. Similarly, a light beam 40 is directed through a node 42 positioned on the center of top plane 12 and through a node 44 positioned on the center of left-side plane 20. These light beams will polymerize the monopolymer material and fuse to other polymerized material.

Figure 3:
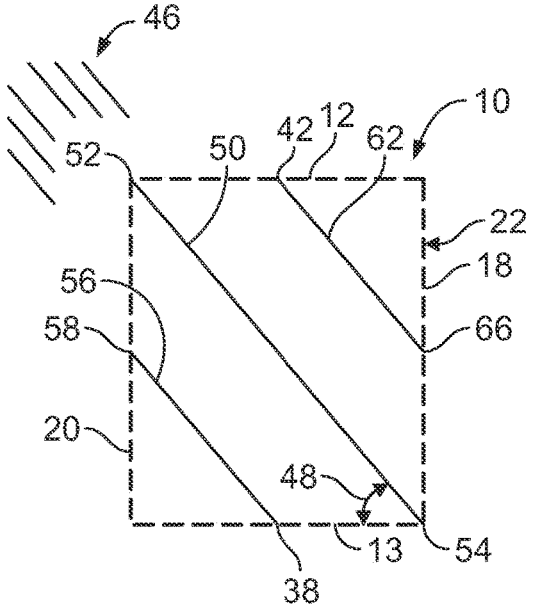
FIG. 3 is a side view of the unit cell of FIGS. 1 and 2 with a collimated beam of light directed through an upper-left corner of the cell.

FIG. 3 shows a side view of the unit cell 10 with a dashed line 22 indicating the boundary of the cell 10. A collimated beam of light 46 is directed at an angle 48 controlled by a mask with apertures (not shown). A light beam 50 is oriented through the upper-left-corner node 52 and lower-right-corner node 54. A parallel beam of light 56 is directed through a node 58 positioned on the center of left-side plane 20 and through a node 38 on the center of bottom plane 13. Similarly, a parallel light beam 62 is directed through a node 42 positioned on the center of top plane 12 and through a node 66 positioned on the center of right-side plane 18. These light beams will polymerize the monopolymer material and fuse to other polymerized material.

Figure 4:
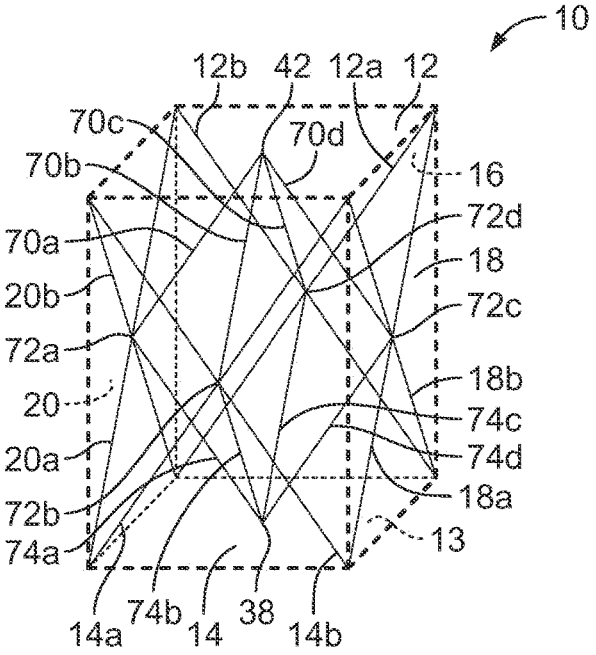
FIG. 4 is a perspective view of a microlattice unit cell resulting from repeating the processes illustrated in FIGS. 3 and 4, according to one embodiment.

This process is repeated for the other sets of vertical planes 12 and 14 resulting in the structure shown in FIG. 4. Long beams 14*a* and 14*b* on front plane 14 are parallel to respective beams 12*a* and 12*b* on rear plane 12. Long beams 18*a* and 18*b* on right plane 18 are parallel to respective beams 20*a* and 20*b* on left plane 20. Short beams 70*a*, 70*b*, 70*c*, and 70*d* connect at upper node 42 centered on top plane 12, and are directed to the center-face nodes 72*a*, 72*b*, 72*c*, and 72*d*. Similarly, short beams 74*a*, 74*b*, 74*c*, and 74*d* connect at lower node 38 centered on bottom plane 13 and connect to the short beams 70*a*, 70*b*, 70*c*, and 70*d* and center-face nodes 72*a*, 72*b*, 72*c*, and 72*d*.

Figure 5:
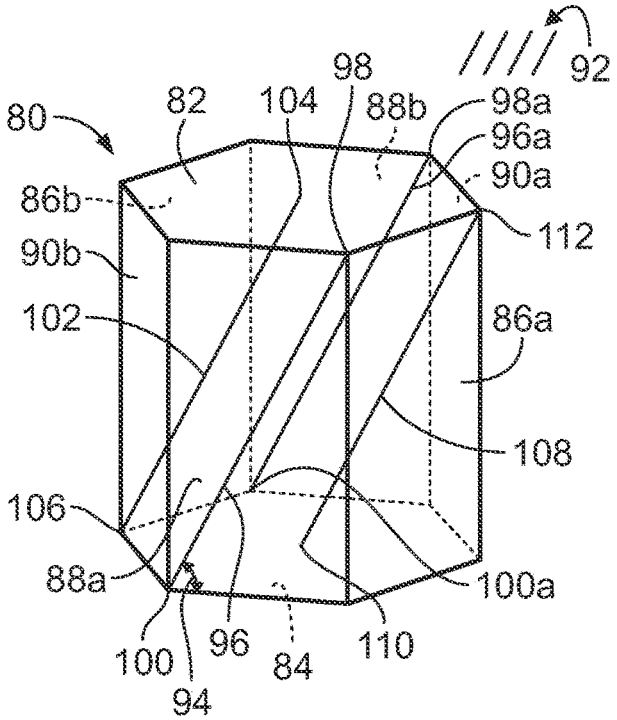
FIG. 5 is a perspective view of a hexagonal unit cell with a collimated beam of light directed through an upper-right region of the cell, according to one embodiment.

Alternatively, a hexagonal shaped cell can be constructed as shown in FIG. 5. A hexagonal unit cell 80 is defined by a hexagonal shaped top plane 82 and opposing bottom plane 84. Vertical plane 86*a* is opposed by vertical plane 86*b*. Vertical plane 88*a* is opposed by vertical plane 88*b*. Vertical plane 90*a* is opposed by vertical plane 90*b*. A collimated light beam 92 is directed at an angle 94 controlled by a mask with apertures (not shown). A beam 96 is formed through upper node 98 and lower node 100 on vertical plane 88*a*. Similarly, a beam 96*a* is formed through upper node 98*a* and lower node 100 on vertical plane 88*b*. A face-to-node beam 102 that is parallel to beams 96 and 96*a* is formed from the center 104 of top face 82 to the lower node 106. Another face-to-node beam 108 that is parallel to beams 96, 96*a*, and 102 is formed from the center 110 of bottom plane 84 to upper node 112.

Figure 6:
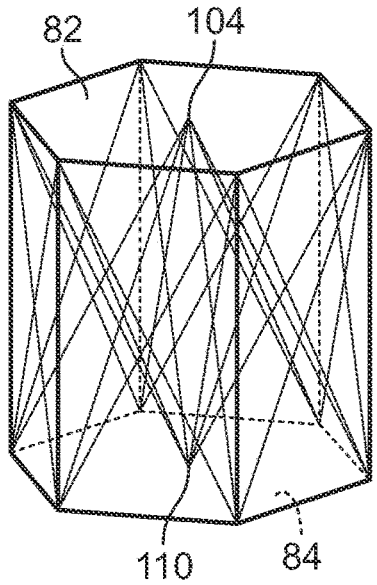
FIG. 6 is a perspective view of a hexagonal microlattice unit cell resulting from repeating the process illustrated in FIG. 5, according to one embodiment.

This process is repeated for the remaining two sets of vertically opposed planes to create the cell structure shown in FIG. 6. The resulting structure has two sets of node-to-node beams in each of the six vertical planes. It also has six face-to-node beams connected at the center node 104 of top plane 82, and six face-to-node beams connected at the center node 110 of bottom plane 84.

Cell structures 10 and 80 shown in FIGS. 4 and 6, respectively, are merely examples of structures that can be created. The cell geometry may vary according to the lattice structure desired. And the density of the microlattice structure may be varied by changing the angle of the beams.

Figure 7:
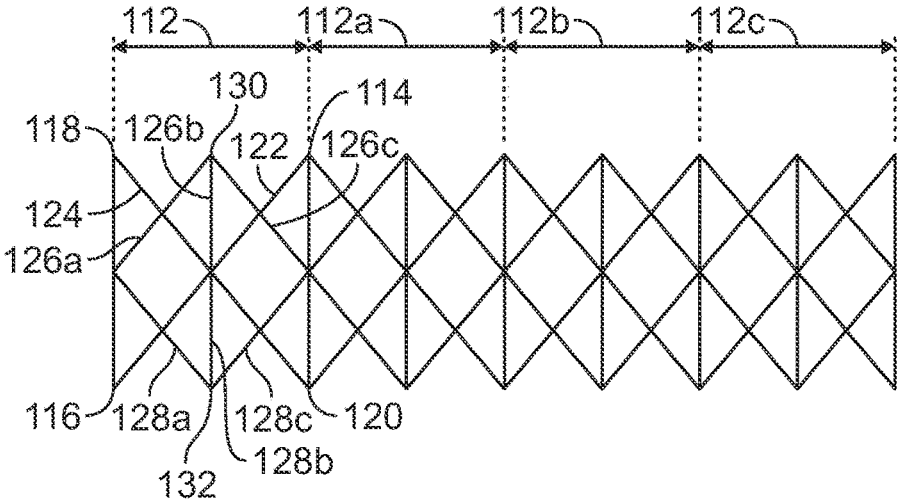
FIG. 7 is a side view of multiple microlattice unit cells of uniform density connected in a row, according to one embodiment.

FIG. 7 is a side view of multiple square cells, such as multiple unit cells 10, connected in a row. This simplified view shows the regular spacing between beams, and the equal cell dimensions. Dimension 112 denotes the width of a single cell unit. Dimension 112=112*a*=112*b*=112*c*, such that all cells are of uniform size and dimensions. The long beam 122 connects corner node 114 to corner node 116. Similarly, long beam 124 connects corner nodes 118 and 120. Short beams 126*a*, 126*b*, 126*c*, and a fourth short beam (not visible) connect to upper-center-face node 130. Similarly, short beams 128*a*, 128*b*, 128*c*, and a fourth short beam (not visible) connect to lower-center-face node 132.

Figure 8:
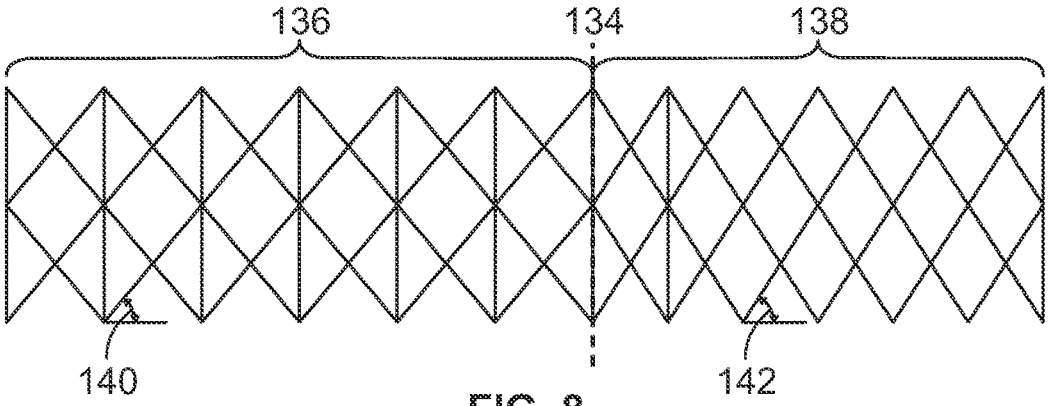
FIG. 8 is a side view of multiple microlattice unit cells of varying density connected in a row, according to one embodiment.

FIG. 8 represents an alternative design in which the density of the microlattice structure varies. To the left of line 134, the microlattice structure 136 has spacing as shown in FIG. 7. To the right of line 134, the microlattice structure 138 has spacing that is tighter and more condensed. In addition, the angle 142 of the beams is greater for structure 138 than the angle 140 for structure 136. Thus, structure 138 provides more compression resistance than structure 136.

Other design alternatives exist to vary the compression resistance of the microlattice structure. For example, the size of the lattice beams may vary by changing the aperture size in the mask. Thus, there are multiple ways to vary and optimize the local stiffness of the microlattice structure.

The microlattice structures described above may be used in a variety of sporting-good applications. For example, one or more microlattice structures may be used as the core of a hockey-stick blade. The stiffness and strength of the microlattice may be designed to optimize the performance of the hockey-stick blade. For example, the density of the microlattice may be higher in the heel area of the blade—where pucks are frequently impacted when shooting slap-shots or trapping pucks—than in the toe region or mid-region of the blade. Further, the microlattice may be more open or flexible toward the toe of the blade to enable a faster wrist shot or to enhance feel and control of the blade.

One or more microlattice structures may also be used to enhance the laminate strength in a hockey-stick shaft, bat barrel, or bat handle. Positioning the microlattice as an inter-laminar ply within a bat barrel, for example, could produce several benefits. The microlattice can separate the inner barrel layers from the outer barrel layers, yet allow the outer barrel to deflect until the microlattice reaches full compression, then return to a neutral position. The microlattice may be denser in the sweet-spot area where the bat produces the most power, and more open in lower-power regions to help enhance bat power away from the sweet spot.

For a hockey-stick shaft or bat handle, the microlattice may be an interlaminar material that acts like a sandwich structure, effectively increasing the wall thickness of the laminate, which increases the stiffness and strength of the shaft or handle.

One or more microlattice structures may also be used in or as a connection material between a handle and a barrel of a ball bat. Connecting joints of this nature have traditionally been made from elastomeric materials, as described, for example, in U.S. Pat. No. 5,593,158, which is incorporated herein by reference. Such materials facilitate relative movement between the bat barrel and handle, thereby absorbing the shock of impact and increasing vibration damping.

A microlattice structure used in or as a connection joint provides an elastic and resilient intermediary that can absorb compression loads and return to shape after impact. In addition, the microlattice can be designed with different densities to make specific zones of the connection joint stiffer than others to provide desired performance benefits. The microlattice structure also offers the ability to tune the degree of isolation of the barrel from the handle to increase the amount of control and damping without significantly increasing the weight of the bat.

Microlattice structures may also be used in helmet liners to provide shock absorption, in bike seats as padding, or in any number of other sporting-good applications. FIGS. 9-16 illustrate some specific examples.

Figure 9:
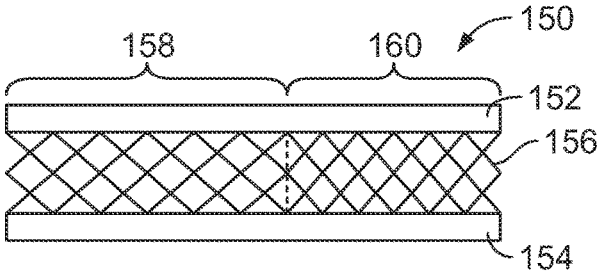
FIG. 9 is a side-sectional view of a hockey-stick blade including a microlattice core structure, according to one embodiment.

FIG. 9 shows a sandwich structure of a hockey-stick blade 150. The top laminate 152 and bottom laminate 154 of the blade 150 may be constructed of fiber-reinforced polymer resin, such as carbon-fiber-reinforced epoxy, or of another suitable material. A microlattice core 156 is positioned between the top and bottom laminates 152, 154. The microlattice core 156 may optionally vary in density such that it is lighter and more open in zone 158 (for example, at the toe-end of the blade), and denser and stronger in zone 160 (for example, at the heel-end of the blade).

Figure 10:
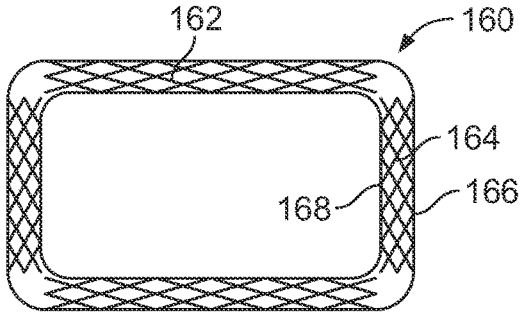
FIG. 10 is a top-sectional view of a hockey-stick shaft including a microlattice core structure between exterior and interior laminates of the shaft, according to one embodiment.

FIG. 10 shows a hockey-stick shaft 160 including a microlattice structure 162 acting as a core between an exterior laminate 166 and an interior laminate 168. Optionally, the microlattice 162 structure may have increased density in one or more shaft regions, such as in region 164 where more impact forces typically occur. Using the microlattice in this manner maintains sufficient wall thickness to resist compressive forces, yet reduces the overall weight of the hockey stick shaft relative to a traditional shaft.

Figure 11:
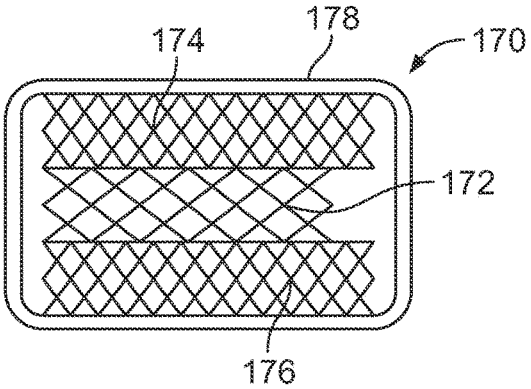
FIG. 11 is a top-sectional view of a hockey-stick shaft including a microlattice core structure in an interior cavity of the shaft, according to one embodiment.

FIG. 11 shows a hockey-stick shaft 170 with a microlattice structure 172 in an interior cavity of the shaft 170. In this embodiment, the microlattice structure is denser in regions 174 and 176 than in the central region 172. The microlattice structure is oriented in this manner to particularly resist compressive forces directed toward the larger dimension 178 of the shaft 170.

Figure 12:
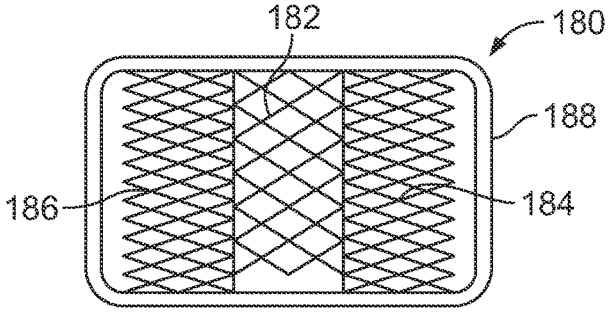
FIG. 12 is a top-sectional view of a hockey-stick shaft including a microlattice core structure in an interior cavity of the shaft, according to another embodiment.

FIG. 12 shows an alternative embodiment of a hockey-stick shaft 180 with a microlattice structure 182 in an interior cavity of the shaft. In this embodiment, the microlattice structure is more dense in regions 184 and 186 than in the central region 182. The microlattice structure is oriented in this manner to particularly resist compressive forces directed toward the smaller dimension 188 of the shaft 180.

Figure 13:
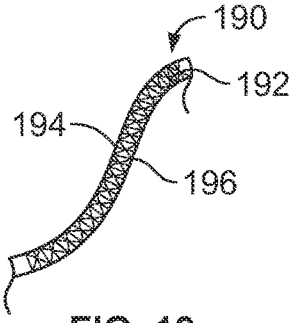
FIG. 13 is a side-sectional view of a portion of a hockey-skate boot including a microlattice core structure between exterior and interior layers of boot material.

FIG. 13 shows a cross section of a portion of a hockey skate boot 190. A microlattice structure 192 is sandwiched between the exterior material 194 and interior material 196 of the boot. The microlattice structure 192 may be formed as a net-shape contour, or formed between the exterior material 194 and the interior material 196. The exterior material 194 and interior material 196 may be textile-based, injection molded, a heat formable thermoplastic, or any other suitable material.

Figure 14:
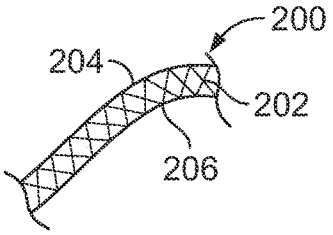
FIG. 14 is a side-sectional view of a portion of a sports helmet including a microlattice core structure between exterior and interior layers of the helmet.

FIG. 14 shows a cross section of a portion of a helmet shell 200. A microlattice structure 202 is sandwiched between the exterior material 204 and interior material 206 of the helmet. The microlattice structure 202 may be created as a net-shape contour, or formed between the exterior material 204 and the interior material 206. The exterior material 204 and interior material 206 may be textile-based, injection molded, a heat formable thermoplastic, or any other suitable material. The interior material 206 may optionally be a very light fabric, depending on the density and design of the microlattice structure 202. The microlattice structure 202 may optionally be a flexible polymer that is able to deform and recover, absorbing impact forces while offering good comfort.

Figure 15:
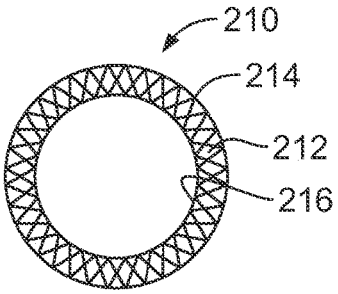
FIG. 15 is a top-sectional view of a bat barrel including a microlattice core structure between exterior and interior layers of the bat barrel.

FIG. 15 shows a cross-sectional view of a bat barrel 210 with a microlattice structure 212 sandwiched between an exterior barrel layer or barrel wall 214 and an interior barrel layer or barrel wall 216. The microlattice structure 212 may be formed as a straight panel that is rolled into the cylindrical shape of the barrel, or it may be formed as a cylinder. The microlattice structure 212 is able to limit the deformation of the exterior barrel wall 214 and to control the power of the bat while facilitating a light weight. The microlattice structure 212 may additionally or alternatively be used in the handle of the bat in a similar manner.

Figure 16:
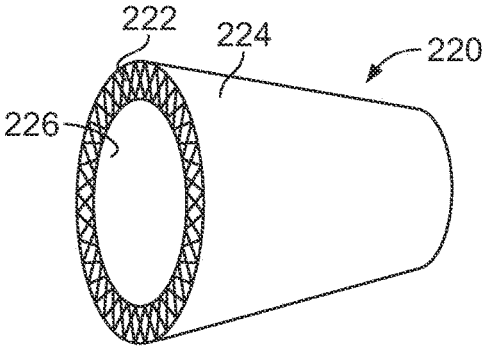
FIG. 16 is a perspective, partial-sectional view of a ball-bat joint including a microlattice core structure between exterior and interior layers of the joint.

FIG. 16 shows a conical joint 220 that may be used to connect a bat handle to a bat barrel. A microlattice structure 222 is sandwiched or otherwise positioned between an exterior material 224 and interior material 226 of the joint 220. The joint 220 may be bonded to the barrel and the handle of the bat or it may be co-molded in place. The barrel and handle may be a composite material, a metal, or any other suitable material or combination of materials. The microlattice structure 222 provides efficient movement of the barrel relative to the handle, and it further absorbs impact forces and dampens vibrations.

Any of the above-described embodiments may be used alone or in combination with one another. Further, the described items may include additional features not described herein. While several embodiments have been shown and described, various changes and substitutions may of course be made, without departing from the spirit and scope of the invention. The invention, therefore, should not be limited, except by the following claims and their equivalents.

We claim:

1. A sport helmet comprising:

a first surface and a second surface opposite one another; and a lattice formed of flexible polymeric material, configured to deform from an initial shape upon an impact on the sport helmet and recover the initial shape thereafter to absorb at least part of the impact, and occupying at least a majority of a cross-sectional dimension of the sport helmet from the first surface of the sport helmet to the second surface of the sport helmet;

wherein: the lattice comprises a regular geometrical arrangement of structural members that are formed of the flexible polymeric material, intersect one another at nodes, are integral and polymerized together at the nodes, and have designed dimensions, orientations and positions relative to one another individually controlled during formation of the structural members from the flexible polymeric material;

respective ones of the nodes of the lattice are spaced from one another in three orthogonal directions that include a thickness-wise direction of the sport helmet from the first surface of the sport helmet to the second surface of the sport helmet; and the designed dimensions, orientations and positions relative to one another of the structural members of the lattice vary between regions of the lattice which are integral and continuous such that a density of the lattice varies between the regions of the lattice.

2. The sport helmet of claim 1, comprising a liner that comprises the lattice.

3. The sport helmet of claim 1, wherein a spacing of the structural members of the lattice is variable.

4. The sport helmet of claim 1, wherein respective ones of the structural members of the lattice vary in size.

5. The sport helmet of claim 1, wherein respective ones of the structural members of the lattice vary in orientation.

6. The sport helmet of claim 1, wherein a resistance to compression of the lattice is variable.

7. The sport helmet of claim 1, wherein a stiffness of the lattice is variable.

8. The sport helmet of claim 1, wherein a first zone of the lattice is stiffer than a second zone of the lattice.

9. The sport helmet of claim 8, wherein: a third zone of the lattice is stiffer than the second zone of the lattice; and the second zone of the lattice is disposed between the first zone of the lattice and the third zone of the lattice.

10. The sport helmet of claim 1, wherein a first zone of the lattice is more open than a second zone of the lattice.

11. The sport helmet of claim 10, wherein: a third zone of the lattice is less open than the first zone of the lattice; and the first zone of the lattice is disposed between the second zone of the lattice and the third zone of the lattice.

12. The sport helmet of claim 1, comprising: a first layer adjacent to the lattice and constituting at least part of the first surface of the sport helmet; and a second layer adjacent to the lattice and constituting at least part of the second surface of the sport helmet.

13. The sport helmet of claim 12, wherein the first layer is injection-molded.

14. The sport helmet of claim 13, wherein the second layer comprises textile material.

15. The sport helmet of claim 12, wherein a material of the first layer and a material of the second layer are different.

16. The sport helmet of claim 1, wherein the lattice is curved.

17. The sport helmet of claim 1, comprising filling material that fills at least part of hollow space of the lattice.

18. The sport helmet of claim 17, wherein the filling material comprises foam.

19. The sport helmet of claim 17, wherein the filling material comprises elastomeric material.

20. The sport helmet of claim 17, wherein the filling material is configured to dampen vibrations.

21. The sport helmet of claim 1, wherein the lattice is optically formed.

22. The sport helmet of claim 21, wherein the lattice is optically formed by collimated light beams.

23. The sport helmet of claim 21, wherein the lattice is optically formed by ultraviolet light.

24. The sport helmet of claim 1, wherein the nodes of the lattice are disposed in at least three levels that are spaced apart from one another in the thickness-wise direction of the sport helmet from the first surface of the sport helmet to the second surface of the sport helmet.

25. The sport helmet of claim 1, wherein the nodes of the lattice are disposed in at least four levels that are spaced apart from one another in the thickness-wise direction of the sport helmet from the first surface of the sport helmet to the second surface of the sport helmet.

26. The sport helmet of claim 1, wherein the nodes of the lattice are disposed in at least five levels that are spaced apart from one another in the thickness-wise direction of the sport helmet from the first surface of the sport helmet to the second surface of the sport helmet.

27. The sport helmet of claim 1, comprising an outer shell and a liner disposed within the outer shell, wherein: the first surface of the sport helmet is an exterior surface of the outer shell; and the second surface of the sport helmet is an interior surface of the liner.

28. The sport helmet of claim 27, wherein the exterior surface of the outer shell comprises injection-molded material; and the interior surface of the liner comprises textile material.

29. The sport helmet of claim 1, wherein the structural members of the lattice extend in at least five different directions.

30. The sport helmet of claim 1, wherein the structural members of the lattice comprise struts.

31. The sport helmet of claim 1, wherein the lattice is configured to be compressed to half of a volume of the lattice and recover the volume of the lattice.

32. The sport helmet of claim 1, wherein the designed dimensions, orientations and positions relative to one another of first ones of the structural members in a first region of the lattice located in a first area of the sport helmet differ from the designed dimensions, orientations and positions relative to one another of second ones of the structural members in a second region of the lattice located in a second area of the sport helmet that is subject to greater impact force than the first area of the sport helmet during a sport.

33. The sport helmet of claim 1, wherein the density of the lattice in a first region of the lattice located in a first area of the sport helmet differs from the density of the lattice in a second region of the lattice located in a second area of the sport helmet that is subject to greater impact force than the first area of the sport helmet during a sport.

34. The sport helmet of claim 1, wherein the regions of the lattice are distributed in a longitudinal direction of the lattice such that the density of the lattice varies in the longitudinal direction of the lattice.

35. The sport helmet of claim 1, wherein the flexible polymeric material comprises a polymeric resin and reinforcing fibers within the polymeric resin.

36. The sport helmet of claim 1, wherein each structural member has a constant cross-sectional dimension along its length.

37. A sport helmet comprising:

an outer shell; and a liner disposed within the outer shell and comprising a lattice;

wherein: the lattice is formed of flexible polymeric material, is configured to deform from an initial shape upon an impact on the sport helmet and recover the initial shape thereafter to absorb at least part of the impact, and occupies at least a majority of a dimension from an exterior surface of the outer shell to an interior surface of the liner; the lattice comprises a regular geometrical arrangement of structural members that are formed of the flexible polymeric material, intersect one another at nodes, are integral and polymerized together at the nodes, and have designed dimensions, orientations and positions relative to one another individually controlled during formation of the structural members from the flexible polymeric material;

respective ones of the nodes of the lattice are spaced apart from one another in three orthogonal directions that include a thickness-wise direction of the sport helmet from the exterior surface of the outer shell to the interior surface of the liner; and the designed dimensions, orientations and positions relative to one another of the structural members of the lattice vary between regions of the lattice which are integral and continuous such that a density of the lattice varies between the regions of the lattice.

38. A sport helmet comprising:

an outer shell; and a liner disposed within the outer shell and comprising a lattice;

wherein: the lattice is formed of flexible polymeric material and configured to deform from an initial shape upon an impact on the sport helmet and recover the initial shape thereafter to absorb at least part of the impact; the lattice comprises a regular geometrical arrangement of structural members that are formed of the flexible polymeric material, intersect one another at nodes, are integral and polymerized together at the nodes, and have designed dimensions, orientations and positions relative to one another individually controlled during formation of the structural members from the flexible polymeric material; respective ones of the nodes of the lattice are spaced apart from one another in three orthogonal directions that include a thickness-wise direction of the sport helmet from an exterior surface of the outer shell to an interior surface of the liner; and the designed dimensions, orientations and positions relative to one another of the structural members of the lattice vary between regions of the lattice which are integral and continuous such that a density of the lattice varies between the regions of the lattice.

39. A sport helmet comprising:

an outer shell; and a liner disposed within the outer shell and comprising a lattice;

wherein: the lattice is formed of flexible polymeric material and is configured to deform from an initial shape upon an impact on the sport helmet and recover the initial shape thereafter to absorb at least part of the impact; the lattice comprises struts that are formed of the flexible polymeric material, intersect one another at nodes, are integral and polymerized together at the nodes, and have designed dimensions, orientations and positions relative to one another individually controlled during formation of the struts from the flexible polymeric material; respective ones of the nodes of the lattice are spaced apart from one another in three orthogonal directions that include a thickness-wise direction of the sport helmet from an exterior surface of the outer shell to an interior surface of the liner; and the designed dimensions, orientations and positions relative to one another of the struts of the lattice vary between regions of the lattice which are integral and continuous such that a density of the lattice varies between the regions of the lattice.

* * * * *